US010891935B2

(12) United States Patent
Bastyr et al.

(10) Patent No.: US 10,891,935 B2
(45) Date of Patent: Jan. 12, 2021

(54) IN-VEHICLE NOISE CANCELLATION ADAPTIVE FILTER DIVERGENCE CONTROL

(71) Applicant: Harman International Industries, Incorporated, Stamford, CT (US)

(72) Inventors: Kevin J. Bastyr, Franklin, MI (US); David Trumpy, Novi, MI (US); Shiyu Chen, Shanghai (CN)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 16/405,150

(22) Filed: May 7, 2019

(65) Prior Publication Data

US 2020/0357377 A1 Nov. 12, 2020

(51) Int. Cl.
*G10K 11/178* (2006.01)

(52) U.S. Cl.
CPC .. *G10K 11/17854* (2018.01); *G10K 11/17817* (2018.01); *G10K 11/17883* (2018.01); *G10K 2210/12821* (2013.01); *G10K 2210/12822* (2013.01)

(58) Field of Classification Search
CPC ..... G10K 11/178; G10K 11/1783; G10K 11/17833; G10K 11/17835; G10K 11/1785; G10K 11/17853; G10K 11/17854; G10K 2210/503; G10K 2210/3218; G10K 2210/3057; G10K 2210/3055; G10K 2210/3054; G10K 2210/3053; G10K 2210/3039; G10K 2210/30391
See application file for complete search history.

(56) References Cited

U.S. PATENT DOCUMENTS 5,295,136 A * 3/1994 Ashley ..... H04B 7/015 370/290
5,581,619 A * 12/1996 Shibata ..... G10K 11/178 381/71.11
5,638,311 A * 6/1997 Fujii ..... G10K 11/178 708/322
5,715,320 A * 2/1998 Allie ..... G10K 11/178 381/71.12
5,809,152 A 9/1998 Nakamura et al.
2012/0057720 A1* 3/2012 Van Leest ..... G10K 11/17833 381/71.11
2013/0195282 A1* 8/2013 Ohita ..... G10K 11/178 381/71.2
2015/0104030 A1* 4/2015 Ueno ..... G10K 11/178 381/71.4
2015/0189433 A1 7/2015 Ganeshkumar
2018/0240452 A1* 8/2018 Every ..... G10K 11/178

* cited by examiner

*Primary Examiner* — Kile O Blair
(74) *Attorney, Agent, or Firm* — Brooks Kushman P.C.

(57) ABSTRACT

A active noise cancellation (ANC) system may include an adaptive filter divergence detector for detecting divergence of the one or more controllable filters as they adapt, based on various temporal or frequency domain amplitude characteristics. Upon detection of a controllable filter divergence, the ANC system may be deactivated, or certain speakers may be muted. Alternatively, the ANC system may modify the diverged controllable filters to restore proper operation of the noise cancelling system. This may include adjusting a leakage value of an adaptive filter controller.

17 Claims, 5 Drawing Sheets

400

| RPM | 2nd | 4th | 6th | 8th |
|---|---|---|---|---|
| 500 | 17 | 33 | 50 | 67 |
| 750 | 25 | 50 | 75 | 100 |
| 1000 | 33 | 67 | 100 | 133 |
| 1250 | 42 | 83 | 125 | 167 |
| 1500 | 50 | 100 | 150 | 200 |
| 1750 | 58 | 117 | 175 | 233 |
| 2000 | 67 | 133 | 200 | 267 |
| 2250 | 75 | 150 | 225 | 300 |
| 2500 | 83 | 167 | 250 | 333 |
| 2750 | 92 | 183 | 275 | 367 |
| 3000 | 100 | 200 | 300 | 400 |
| 3600 | 120 | 240 | 360 | 480 |
| 4000 | 133 | 267 | 400 | 533 |
| 5000 | 167 | 333 | 500 | 667 |
| 6000 | 200 | 400 | 600 | 800 |

IN-VEHICLE NOISE CANCELLATION ADAPTIVE FILTER DIVERGENCE CONTROL

TECHNICAL FIELD

The present disclosure is directed to active noise cancellation and, more particularly, to mitigating the effects of adaptive filter divergence in engine order cancellation and/or road noise cancellation systems.

BACKGROUND

Active Noise Control (ANC) systems attenuate undesired noise using feedforward and feedback structures to adaptively remove undesired noise within a listening environment, such as within a vehicle cabin. ANC systems generally cancel or reduce unwanted noise by generating cancellation sound waves to destructively interfere with the unwanted audible noise. Destructive interference results when noise and "anti-noise," which is largely identical in magnitude but opposite in phase to the noise, reduce the sound pressure level (SPL) at a location. In a vehicle cabin listening environment, potential sources of undesired noise come from the engine, the interaction between the vehicle's tires and a road surface on which the vehicle is traveling, and/or sound radiated by the vibration of other parts of the vehicle. Therefore, unwanted noise varies with the speed, road conditions, and operating states of the vehicle.

A Road Noise Cancellation (RNC) system is a specific ANC system implemented on a vehicle in order to minimize undesirable road noise inside the vehicle cabin. RNC systems use vibration sensors to sense road induced vibrations generated from the tire and road interface that leads to unwanted audible road noise. This unwanted road noise inside the cabin is then cancelled, or reduced in level, by using speakers to generate sound waves that are ideally opposite in phase and identical in magnitude to the noise to be reduced at one or more listeners' ears. Cancelling such road noise results in a more pleasurable ride for vehicle passengers, and it enables vehicle manufacturers to use lightweight materials, thereby decreasing energy consumption and reducing emissions.

An Engine Order Cancellation (EOC) system is a specific ANC system implemented on a vehicle in order to minimize undesirable vehicle interior noise originating from the narrowband acoustic and vibrational emissions from the vehicle engine and exhaust system. EOC systems use a non-acoustic signal, such as a revolutions-per-minute (RPM) sensor, that generates a reference signal representative of the engine speed as a reference. This reference signal is used to generate sound waves that are opposite in phase to the engine noise audible in the vehicle interior. Because EOC systems use data from an RPM sensor, they do not require vibrations sensors.

RNC systems are typically designed to cancel broadband signals, while EOC systems are designed and optimized to cancel narrowband signals, such as individual engine orders. ANC systems within a vehicle may provide both RNC and EOC technology. Such vehicle-based ANC systems are typically Least Mean Square (LMS) adaptive feed-forward systems that continuously adapt W-filters based on noise inputs (e.g., acceleration inputs from the vibrations sensors in an RNC system) and signals of error microphones located in various positions inside the vehicle's cabin. ANC systems are susceptible to instability or divergence of the adaptive W-filters. As the W-filters are adapted by the LMS system, one or more of the W-filters may diverge, rather than converge to minimize the pressure at the location of an error microphone. Generally, the first taps in the adaptive W-filters represented in the time domain have a high amplitude and the amplitude decreases to zero in the later taps. However, if the adaptive W-filters diverge, they may not have this character. Divergence of the adaptive filters may lead to broad- or narrow-band noise boosting or other undesirable behavior of the ANC system.

SUMMARY

In one or more illustrative embodiments, a method for controlling stability in an active noise cancellation (ANC) system is provided. The method may include receiving, from an adaptive filter controller, filter coefficients corresponding to at least one controllable filter. The method may further include computing a parameter based on an analysis of at least a portion of the filter coefficients, detecting divergence of the at least one controllable filter based on a comparison of the parameter to a threshold, and modifying properties of the at least one controllable filter that has diverged.

Implementations may include one or more of the following features. The controllable filter may include a plurality of coefficients. The parameter may be a sum of absolute values of at least a portion of the coefficients in the at least one controllable filter. The parameter may be a maximum value of at least a portion of the coefficients in the at least one controllable filter.

Moreover, detecting divergence of the at least one controllable filter based on a comparison of the parameter to a threshold may comprise detecting divergence of the at least one controllable filter when the parameter exceeds the threshold. The threshold may be a dynamic threshold computed from a statistical analysis of the parameter computed from filter coefficients in one or more preceding adaptations of the at least one controllable filter. The threshold may be an average value of the parameter taken from multiple preceding adaptations of the at least one controllable filter multiplied by a gain factor.

Further, detecting divergence of the at least one controllable filter based on a comparison of the parameter to a threshold may comprise: comparing the parameter from a current adaptation of the at least one controllable filter to an average value of a same parameter from one or more previous adaptations of the at least one controllable filter; and detecting divergence of the at least one controllable filter when a difference between the parameter from the current adaptation of the at least one controllable filter and the average value from the one or more previous adaptations of the at least one controllable filter exceeds a threshold.

Modifying properties of the at least one controllable filter that has diverged may include deactivating at least one of the ANC system and the at least one controllable filter that has diverged. Alternatively, modifying properties of the at least one controllable filter that has diverged may include resetting the filter coefficients of the at least one controllable filter to zero and allowing the at least one controllable filter to re-adapt, or it may include resetting the filter coefficients of the at least one controllable filter to a set of filter coefficient values stored in a memory of the ANC system.

Additionally, modifying properties of the at least one controllable filter that has diverged may include increasing a leakage value of the adaptive filter controller in response to detecting divergence of the at least one controllable filter. The leakage value of the adaptive filter controller may be increased at the diverged frequencies of the at least one controllable filter. Moreover, the method may further include decreasing the leakage value of the adaptive filter controller when a highest magnitude filter coefficient of the at least one controllable filter falls below a predetermined threshold.

One or more additional embodiments may be directed to an ANC system including at least one controllable filter configured to generate an anti-noise signal based on an adaptive transfer characteristic and a noise signal received from a sensor. The adaptive transfer characteristic of the at least one controllable filter may be characterized by a set of filter coefficients. The ANC system may further include an adaptive filter controller and a divergence controller in communication with at least the adaptive filter controller. The adaptive filter controller may include a processor and memory programmed to adapt the set of filter coefficients based on the noise signal and an error signal received from a microphone located in a cabin of a vehicle. The divergence controller may include a processor and memory programmed to: receive the set of filter coefficients corresponding to a current adaptation of the adaptive transfer characteristic of the at least one controllable filter; compute a parameter based on an analysis of at least a portion of the set of filter coefficients; and detect divergence of the at least one controllable filter based on a comparison of the parameter to a threshold.

Implementations may include one or more of the following features. The threshold may be a predetermined static threshold programmed for the ANC system. The divergence controller may be programmed to detect divergence of the at least on controllable filter when a difference between the parameter computed from the current adaptation of the at least one controllable filter and an average value of a same parameter from one or more previous adaptations of the at least one controllable filter exceeds the threshold. The divergence controller may be further programmed to increase a leakage value of the adaptive filter controller in response to detecting divergence of the at least one controllable filter.

One or more additional embodiments may be directed to a computer-program product embodied in a non-transitory computer readable medium that is programmed for active noise cancellation (ANC). The computer-program product may include instructions for: receiving, from an adaptive filter controller, a set of filter coefficients corresponding to a current adaptation of at least one controllable filter; computing a parameter based on an analysis of at least a portion of the filter coefficients; detecting divergence of the at least one controllable filter based on a comparison of the parameter to a threshold; and modifying an adaptive transfer characteristic of the at least one controllable filter during the current adaptation in response to detecting divergence of the at least one controllable filter.

Implementations may include one or more of the following features. The computer-program product where the instructions for detecting divergence of the at least one controllable filter may include detecting, in the time domain, diverged frequencies of the at least one controllable filter; and where the instructions for modifying the adaptive transfer characteristic may include, in the time domain, resetting the diverged frequencies of the at least one controllable filter to zero, attenuating the filter coefficients at the diverged frequencies, or increasing a leakage value of the adaptive filter controller at the diverged frequencies. Moreover, the instructions for detecting divergence of the at least one controllable filter may include detecting, in the frequency domain, diverged frequencies of the at least one controllable filter; and the instructions for modifying the adaptive transfer characteristic may include, in the frequency domain, notching out the diverged frequencies using an error signal received from a microphone and filter coefficients from a previous adaptation of the at least one controllable filter stored in memory.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Any one or more of the controllers or devices described herein include computer executable instructions that may be compiled or interpreted from computer programs created using a variety of programming languages and/or technologies. In general, a processor (such as a microprocessor) receives instructions, for example from a memory, a computer-readable medium, or the like, and executes the instructions. A processing unit includes a non-transitory computer-readable storage medium capable of executing instructions of a software program. The computer readable storage medium may be, but is not limited to, an electronic storage device, a magnetic storage device, an optical storage device, an electromagnetic storage device, a semi-conductor storage device, or any suitable combination thereof.

Figure 1:
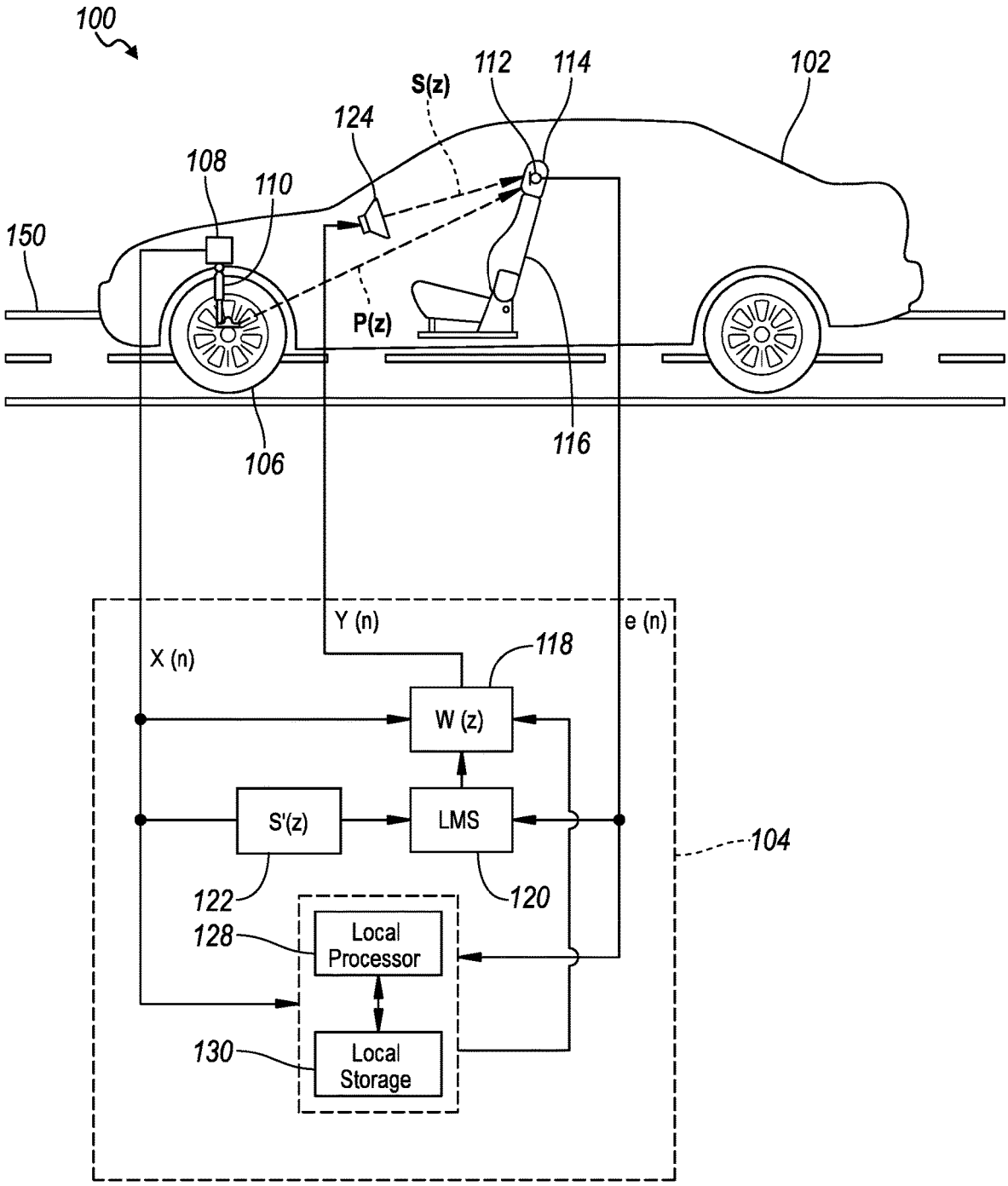
FIG. 1 is an environmental block diagram of a vehicle having an active noise control (ANC) system including a road noise cancellation (RNC), in accordance with one or more embodiments of the present disclosure.

FIG. 1 shows a road noise cancellation (RNC) system 100 for a vehicle 102 having one or more vibration sensors 108. The vibration sensors are disposed throughout the vehicle 102 to monitor the vibratory behavior of the vehicle's suspension, subframe, as well as other axle and chassis components. The RNC system 100 may be integrated with a broadband feed-forward and feedback active noise control (ANC) framework or system 104 that generates anti-noise by adaptive filtering of the signals from the vibration sensors 108 using one or more microphones 112. The anti-noise signal may then be played through one or more speakers 124. S(z) represents a transfer function between a single speaker 124 and a single microphone 112. While FIG. 1 shows a single vibration sensor 108, microphone 112, and speaker 124 for simplicity purposes only, it should be noted that typical RNC systems use multiple vibration sensors 108 (e.g., 10 or more), microphones 112 (e.g., 4 to 6), and speakers 124 (e.g., 4 to 8).

The vibration sensors 108 may include, but are not limited to, accelerometers, force gauges, geophones, linear variable differential transformers, strain gauges, and load cells. Accelerometers, for example, are devices whose output signal amplitude is proportional to acceleration. A wide variety of accelerometers are available for use in RNC systems. These include accelerometers that are sensitive to vibration in one, two and three typically orthogonal directions. These multi-axis accelerometers typically have a separate electrical output (or channel) for vibrations sensed in their X-direction, Y-direction and Z-direction. Single-axis and multi-axis accelerometers, therefore, may be used as vibration sensors 108 to detect the magnitude and phase of acceleration and may also be used to sense orientation, motion, and vibration.

Noise and vibrations that originate from a wheel 106 moving on a road surface 150 may be sensed by one or more of the vibration sensors 108 mechanically coupled to a suspension device 110 or a chassis component of the vehicle 102. The vibration sensor 108 may output a noise signal X(n), which is a vibration signal that represents the detected road-induced vibration. It should be noted that multiple vibration sensors are possible, and their signals may be used separately, or may be combined in various ways known by those skilled in the art. In certain embodiments, a microphone may be used in place of a vibration sensor to output the noise signal X(n) indicative of noise generated from the interaction of the wheel 106 and the road surface 150. The noise signal X(n) may be filtered with a modeled transfer characteristic S'(z), which estimates the secondary path (i.e., the transfer function between an anti-noise speaker 124 and an error microphone 112), by a secondary path filter 122.

Road noise that originates from interaction of the wheel 106 and the road surface 150 is also transferred, mechanically and/or acoustically, into the passenger cabin and is received by the one or more microphones 112 inside the vehicle 102. The one or more microphones 112 may, for example, be located in a headrest 114 of a seat 116 as shown in FIG. 1. Alternatively, the one or more microphones 112 may be located in a headliner of the vehicle 102, or in some other suitable location to sense the acoustic noise field heard by occupants inside the vehicle 102. The road noise originating from the interaction of the road surface 150 and the wheel 106 is transferred to the microphone 112 according to a transfer characteristic P(z), which represents the primary path (i.e., the transfer function between an actual noise source and an error microphone).

The microphones 112 may output an error signal e(n) representing the noise present in the cabin of the vehicle 102 as detected by the microphones 112. In the RNC system 100, an adaptive transfer characteristic W(z) of a controllable filter 118 may be controlled by adaptive filter controller 120, which may operate according to a known least mean square (LMS) algorithm based on the error signal e(n) and the noise signal X(n) filtered with the modeled transfer characteristic S'(z) by the filter 122. The controllable filter 118 is often referred to as a W-filter. The LMS adaptive filter controller 120 may provide a summed cross-spectrum configured to update the transfer characteristic W(z) filter coefficients based on the error signals e(n). The process of adapting or updating W(z) that results in improved noise cancellation is referred to as converging. Convergence refers to the creation of W-filters that minimize the error signals e(n), which is controlled by a step size governing the rate of adaption for the given input signals. The step size is a scaling factor that dictates how fast the algorithm will converge to minimize e(n) by limiting the magnitude change of the W-filter coefficients based on each update of the controllable W-filter 118.

An anti-noise signal Y(n) may be generated by an adaptive filter formed by the controllable filter 118 and the adaptive filter controller 120 based on the identified transfer characteristic W(z) and the vibration signal, or a combination of vibration signals, X(n). The anti-noise signal Y(n) ideally has a waveform such that when played through the speaker 124, anti-noise is generated near the occupants' ears and the microphone 112 that is substantially opposite in phase and identical in magnitude to that of the road noise audible to the occupants of the vehicle cabin. The anti-noise from the speaker 124 may combine with road noise in the vehicle cabin near the microphone 112 resulting in a reduction of road noise-induced sound pressure levels (SPL) at this location. In certain embodiments, the RNC system 100 may receive sensor signals from other acoustic sensors in the passenger cabin, such as an acoustic energy sensor, an acoustic intensity sensor, or an acoustic particle velocity or acceleration sensor to generate error signal e(n).

While the vehicle 102 is under operation, a processor 128 may collect and optionally processes the data from the vibration sensors 108 and the microphones 112 to construct a database or map containing data and/or parameters to be used by the vehicle 102. The data collected may be stored locally at a storage 130, or in the cloud, for future use by the vehicle 102. Examples of the types of data related to the RNC system 100 that may be useful to store locally at storage 130 include, but are not limited to, optimal W-filters, W-filter thresholds, initial W-filters, W-filter gain factors, leakage increment and decrement amounts, accelerometer or microphone spectra or time dependent signals, and engine SPL versus Torque and RPM. In one or more embodiments, the processor 128 and storage 130 may be integrated with one or more RNC system controllers, such as the adaptive filter controller 120.

As previously described, typical RNC systems may use several vibration sensors, microphones and speakers to sense structure-borne vibratory behavior of a vehicle and generate anti-noise. The vibrations sensor may be multi-axis accelerometers having multiple output channels. For instance, triaxial accelerometers typically have a separate electrical output for vibrations sensed in their X-direction, Y-direction, and Z-direction. A typical configuration for an RNC system may have, for example, 6 error microphones, 6 speakers, and 12 channels of acceleration signals coming from 4 triaxial accelerometers or 6 dual-axis accelerometers. Therefore, the RNC system will also include multiple S'(z) filters (i.e., secondary path filters 122) and multiple W(z) filters (i.e., controllable filters 118).

The simplified RNC system schematic depicted in FIG. 1 shows one secondary path, represented by S(z), between each speaker 124 and each microphone 112. As previously mentioned, RNC systems typically have multiple speakers, microphones and vibration sensors. Accordingly, a 6-speaker, 6-microphone RNC system will have 36 total secondary paths (i.e., 6×6). Correspondingly, the 6-speaker, 6-microphone RNC system may likewise have 36 S'(z) filters (i.e., stored secondary path filters 122), which estimate the transfer function for each secondary path. As shown in FIG. 1, an RNC system will also have one W(z) filter (i.e., controllable filter 118) between each noise signal X(n) from a vibration sensor (i.e., accelerometer) 108 and each speaker 224. Accordingly, a 12-accelerometer signal, 6-speaker RNC system may have 72 W(z) filters. The relationship between the number of accelerometer signals, speakers, and W(z) filters is illustrated in FIG. 2.

Figure 2:
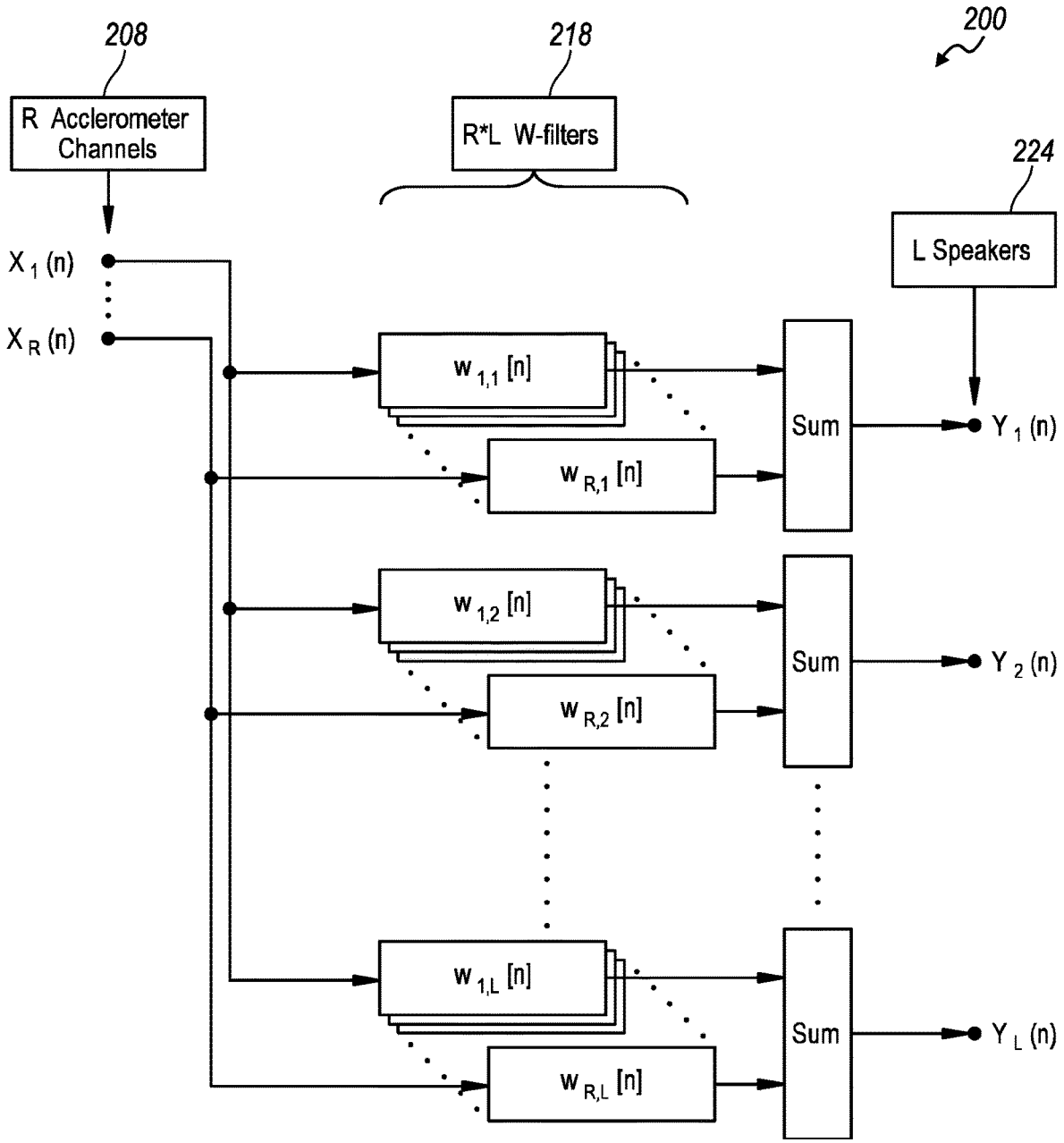
FIG. 2 is a sample schematic diagram demonstrating relevant portions of an RNC system scaled to include R accelerometer signals and L speaker signals.

FIG. 2 is a sample schematic diagram demonstrating relevant portions of an RNC system 200 scaled to include R accelerometer signals $[X_1(n), X_2(n), \ldots X_R(n)]$ from accelerometers 208 and L speaker signals $[Y_1(n), Y_2(n), \ldots Y_L(n)]$ from speakers 224. Accordingly, the RNC system 200 may include R*L controllable filters (or W-filters) 218 between each of the accelerometer signals and each of the speakers. As an example, an RNC system having 12 accelerometer outputs (i.e., R=12) may employ 6 dual-axis accelerometers or 4 triaxial accelerometers. In the same example, a vehicle having 6 speakers (i.e., L=6) for reproducing anti-noise, therefore, may use 72 W-filters in total. At each of the L speakers, R W-filter outputs are summed to produce the speaker's anti-noise signal Y(n). Each of the L speakers may include an amplifier (not shown). In one or more embodiments, the R accelerometer signals filtered by the R W-filters are summed to create an electrical anti-noise signal y(n), which is fed to the amplifier to generate an amplified anti-noise signal Y(n) that is sent to a speaker.

The ANC system 104 illustrated in FIG. 1 may also include an engine order cancellation (EOC) system. As mentioned above, EOC technology uses a non-acoustic signal such as an RPM signal representative of the engine speed as a reference in order to generate sound that is opposite in phase to the engine noise audible in the vehicle interior. Common EOC systems utilize a narrowband feed-forward ANC framework to generate anti-noise using an RPM signal to guide the generation of an engine order signal identical in frequency to the engine order to be cancelled, and adaptively filtering it to create an anti-noise signal. After being transmitted via a secondary path from an anti-noise source to a listening position or error microphone, the anti-noise ideally has the same amplitude, but opposite phase, as the combined sound generated by the engine and exhaust pipes and filtered by the primary paths that extend from the engine to the listening position and from the exhaust pipe outlet to the listening position. Thus, at the place where an error microphone resides in the vehicle cabin (i.e., most likely at or close to the listening position), the superposition of engine order noise and anti-noise would ideally become zero so that acoustic error signal received by the error microphone would only record sound other than the (ideally cancelled) engine order or orders generated by the engine and exhaust.

Commonly, a non-acoustic sensor, for example an RPM sensor, is used as a reference. RPM sensors may be, for example, Hall Effect sensors which are placed adjacent to a spinning steel disk. Other detection principles can be employed, such as optical sensors or inductive sensors. The signal from the RPM sensor can be used as a guiding signal for generating an arbitrary number of reference engine order signals corresponding to each of the engine orders. The reference engine orders form the basis for noise cancelling signals generated by the one or more narrowband adaptive feed-forward LMS blocks that form the EOC system.

Figures 3, 4:
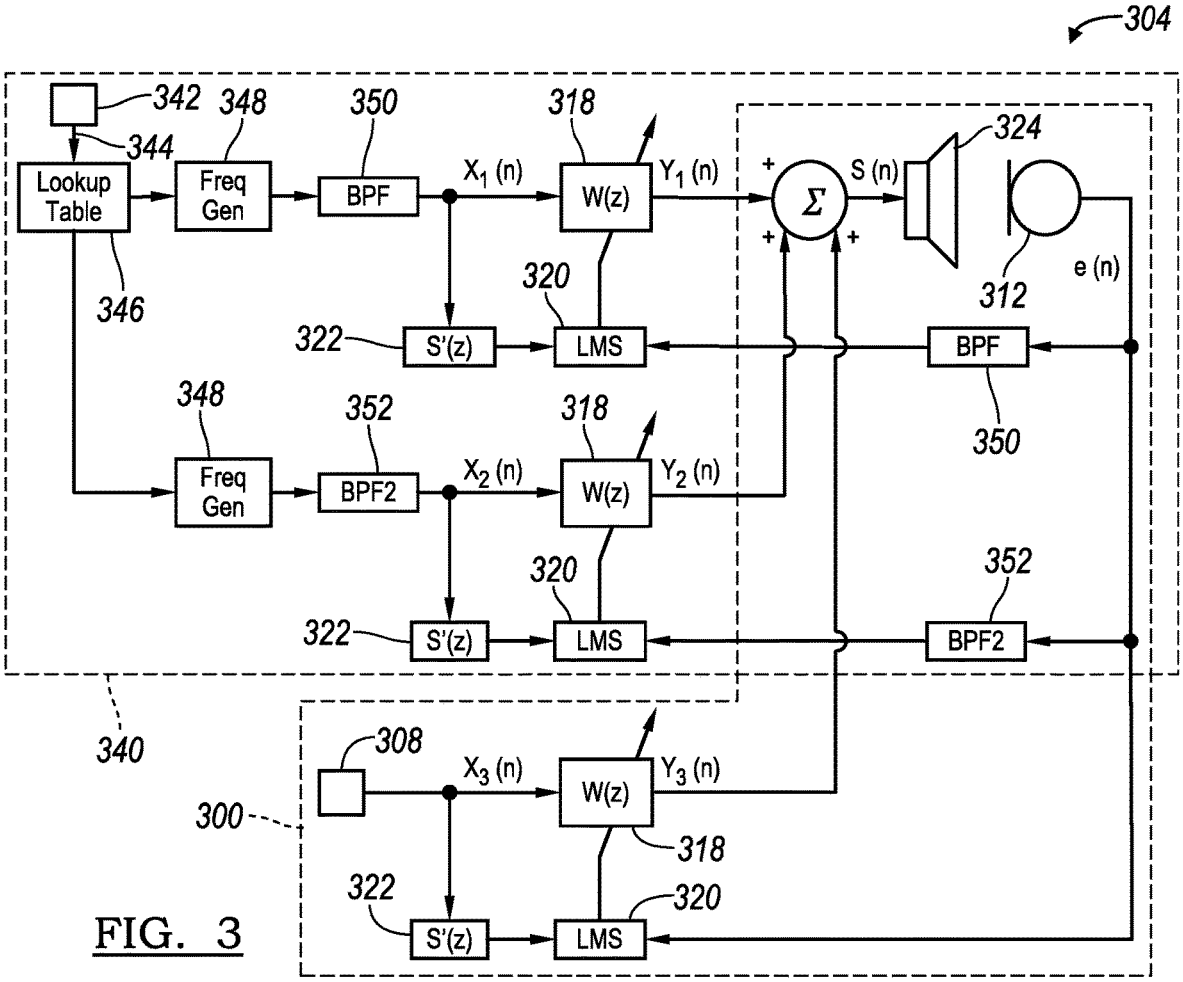
FIG. 3 is a sample schematic block diagram of an ANC system including an engine order cancellation (EOC) system and an RNC system.
FIG. 4 is a sample lookup table of frequencies of each engine order for a given RPM in an EOC system.

FIG. 3 is a schematic block diagram illustrating an example of an ANC system 304, including both an RNC system 300 and an EOC system 340. Similar to RNC system 100, the RNC system 300 may include elements 308, 312, 318, 320, 322, and 324, consistent with operation of elements 108, 112, 118, 120, 122, and 124, respectively, discussed above. The EOC system 340 may include an RPM sensor 342, which may provide an RPM signal 344 (e.g., a square-wave signal) indicative of rotation of an engine drive shaft or other rotating shaft indicative of the engine rotational speed. In some embodiments, the RPM signal 344 may be obtained from a vehicle network bus (not shown). As the radiated engine orders are directly proportional to the drive shaft RPM, the RPM signal 344 is representative of the frequencies produced by the engine and exhaust system. Thus, the signal from the RPM sensor 342 may be used to generate reference engine order signals corresponding to each of the engine orders for the vehicle. Accordingly, the RPM signal 344 may be used in conjunction with a lookup table 346 of RPM vs. Engine Order Frequency, which provides a list of engine orders radiated at each engine RPM.

FIG. 4 illustrates an example EOC cancellation tuning table 400, which may be used to generate lookup table 346. The example table 400 lists frequencies (in cycles per second) of each engine order for a given RPM. In the illustrated example, four engine orders are shown. The LMS algorithm takes as an input the RPM and generates a sine wave for each order based on this lookup table 400. As previously described, the relevant RPM for the table 400 may be drive shaft RPM.

Referring back to FIG. 3, the frequency of a given engine order at the sensed RPM, as retrieved from the lookup table 346, may be supplied to a frequency generator 348, thereby generating a sine wave at the given frequency. This sine wave represents a noise signal X(n) indicative of engine order noise for a given engine order. Similar to the RNC system 300, this noise signal X(n) from the frequency generator 348 may be sent to an adaptive controllable filter 318, or W-filter, which provides a corresponding anti-noise signal Y(n) to the loudspeaker 324. As shown, various components of this narrowband, EOC system 340 may be identical to the broadband RNC system 300, including the error microphone 312, adaptive filter controller 320 and secondary path filter 322. The anti-noise signal Y(n), broadcast by the speaker 324 generates anti-noise that is substantially out of phase but identical in magnitude to the actual engine order noise at the location of a listener's ear, which may be in close proximity to an error microphone 312, thereby reducing the sound amplitude of the engine order. Because engine order noise is narrowband, the error microphone signal e(n) may be filtered by a bandpass filter 350, 352 prior to passing into the LMS-based adaptive filter controller 320. In an embodiment, proper operation of the LMS adaptive filter controller 320 is achieved when the noise signal X(n) output by the frequency generator 348 is bandpass filtered using the same bandpass filter parameters.

In order to simultaneously reduce the amplitude of multiple engine orders, the EOC system 340 may include multiple frequency generators 348 for generating a noise signal X(n) for each engine order based on the RPM signal 344. As an example, FIG. 3 shows a two order EOC system having two such frequency generators for generating a unique noise signal (e.g., $X_1(n)$, $X_2(n)$, etc.) for each engine order based on engine speed. Because the frequency of the two engine orders differ, the bandpass filters 350, 352 (labeled BPF and BPF2, respectively) have different high- and low-pass filter corner frequencies. The number of frequency generators and corresponding noise-cancellation components will ultimately vary based on the number of engine orders for a particular engine of the vehicle. As the two-order EOC system 340 is combined with the RNC system 300 to form ANC system 304, the anti-noise signals Y(n) output from the three controllable filters 318 are summed and sent to the speaker 324 as a speaker signal S(n). Similarly, the error signal e(n) from the error microphone 312 may be sent to the three LMS adaptive filter controllers 320.

One leading factor that can lead to instability or reduced noise cancellation performance in ANC systems occurs when the adaptive W-filters diverge during adaptation by the feed-forward LMS system. When the adaptive W-filters properly converge, sound pressure levels (and related error signals e(n)) at the location of error microphones are minimized. However, when one or more of these adaptive W-filters diverge, noise boosting may occur instead. Generally, the first taps in the adaptive W-filters have a high amplitude, and the amplitude decreases to zero in the later taps. However, if the LMS ANC system diverges, one or more W-filters may not have this character. Accordingly, a system and method may be employed to detect and control the divergence of adaptive filters to maintain ANC system performance and stability. Briefly, the W-filter values (i.e., the adaptive filter coefficients) may be compared to predetermined thresholds either in the time or frequency domain. If values of the W-filters exceed these thresholds, divergence mitigation may be employed to prevent noise boosting or other undesirable behavior. Divergence mitigation may include, for example, muting the ANC system, resetting the diverged W-filters to a zero state or some other stored state, adding leakage at frequencies including the diverged frequencies, and the like.

Figure 5:
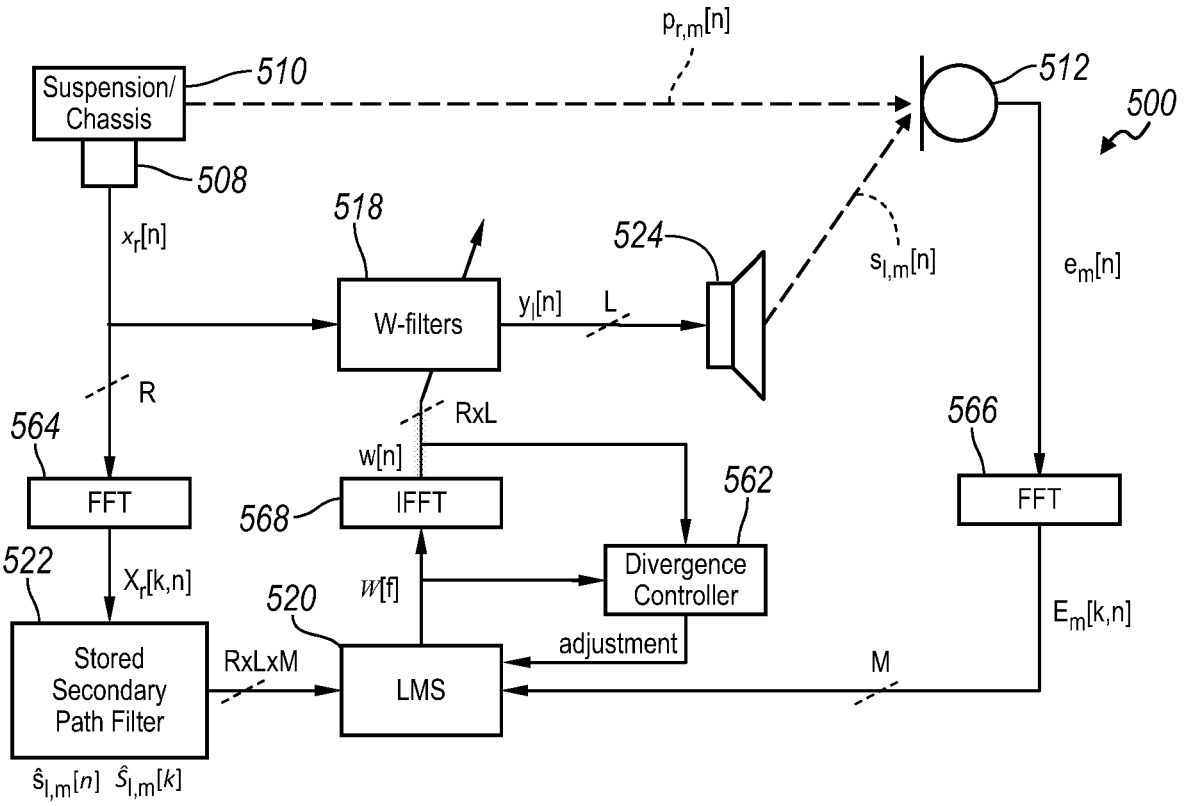
FIG. 5 is a schematic block diagram representing an ANC system including a divergence controller, in accordance with one or more embodiments of the present disclosure.

FIG. 5 is a schematic block diagram of a vehicle-based ANC system 500 showing many of the key ANC system parameters that may be used to detect divergence of the adaptive W-filters and optimize ANC system performance. For ease of explanation, the ANC system 500 illustrated in FIG. 5 is shown with components and features of an RNC system, such as RNC system 100. However, the ANC system 500 may include an EOC system such as shown and described in connection with FIG. 3. Accordingly, the ANC system 500 is a schematic representation of an RNC and/or EOC system, such as those described in connection with FIGS. 1-3, featuring additional system components. Similar components may be numbered using a similar convention. For instance, similar to RNC system 100, the ANC system 500 may include elements 508, 510, 512, 518, 520, 522, and 524, consistent with operation of elements 108, 110, 112, 118, 120, 122, and 124, respectively, discussed above.

As shown, the ANC system 500 may further include a divergence controller 562 disposed along the path between the controllable filter 518 and the adaptive filter controller 520. The divergence controller 562 may include a processor and memory (not shown) programmed to detect divergence of the controllable filters 518. This may include computing parameters by analyzing samples from the adaptive filter values (e.g., filter coefficients) in either or both the time domain or the frequency domain. To this end, FIG. 5 explicitly illustrates Fast Fourier transform (FFT) blocks 564, 566 and inverse Fast Fourier transform (IFFT) block 568 for transforming signals between the time and frequency domain. Accordingly, variable names in FIG. 5 are slightly altered from those shown in FIGS. 1-3. Upper-case variables represent signals in the frequency domain, while lower-case variables represent signals in the time domain. The letter "n" denotes a sample in the time domain, while the letter "k" denotes a bin in the frequency domain. The diagram in FIG. 5 further illustrates the presence of multiple signals, showing R reference signals, L speaker signals and M error signals. The table below provides a detailed explanation of the various symbols and variables in FIG. 5.

| Symbol | Definition |
|---|---|
| [n] | Sample in the time domain |
| [k] | Bin in the frequency domain |
| R | Total dimensional number of reference noise signals |
| L | Total dimensional number of anti-noise signals |
| M | Total dimensional number of error signals |
| r | Individual reference noise signal, r = 1 . . . R |
| l | Individual anti-noise signal, l = 1 . . . L |
| m | Individual error signal, m = 1 . . . M |
| $x_r[n]$ | Reference noise signals in the time domain |
| $X_r[k, n]$ | Time-dependent reference noise signals in the frequency domain |
| $\hat{S}_{l,m}[k]$ | Estimated secondary paths in the frequency domain, LxM matrix |
| $\hat{s}_{l,m}[n]$ | Estimated secondary paths in the time domain, LxM matrix |
| $s_{l,m}[n]$ | Secondary path in the time domain, LxM matrix |
| $p_{r,m}[k, n]$ | Time-dependent primary propagation paths in the frequency domain, RxM matrix |
| $y_l[n]$ | Anti-noise signals in the time domain |
| $e_m[n]$ | Error signals in the time domain |
| $E_m[k, n]$ | Time-dependent error signals in the frequency domain |

Similar to FIG. 1, the noise signal $x_r[n]$ from the noise input, such as vibration sensor 508, may be transformed and filtered with a modeled transfer characteristic $\hat{S}_{l,m}[k]$, using stored estimates of the secondary path as previously described, by a secondary path filter 522. Moreover, an adaptive transfer characteristic $w_{r,l}[n]$ of a controllable filter 518 (e.g., a W-filter) may be controlled by LMS adaptive filter controller (or simply LMS controller) 520 to provide an adaptive filter. The noise signal, as filtered by the secondary path filter 522, and an error signal $e_m[n]$ from the microphone 512 are inputs to the LMS adaptive filter controller 520. The anti-noise signal $y_l[n]$ may be generated by the controllable filter 518, adapted by LMS controller 520 and the noise signal $x_r[n]$.

The divergence controller 562 may receive the time domain filter coefficients $w_{r,l}[n]$ and/or frequency domain filter coefficients $W_{r,l}[k]$ for each adaptation of the controllable filter 518 generated by the LMS adaptive filter controller 520. Moreover, the divergence controller 562 may compute one or more parameters by analyzing the filter coefficients. If divergence of one or more controllable filters is detected, the divergence controller 562 may send a signal back to the adaptive filter controller 520, such as an adjustment signal, instructing the adaptive filter controller to modify properties of the at least one controllable filter 518 that has diverged. For instance, in either RNC or EOC systems, the response to detecting divergence of a controllable W-filter 518 may be for the divergence controller 562 to substitute for the diverged W-filter values using, for example, adjusted W-filters that have been previously stored. Other responses to the detection of W-filter divergence by the divergence controller 562 may include replacing the controllable filter 518 with a filter consisting of zeros, which effectively resets the controllable filter. Other divergence mitigation measures by the divergence controller 562 may include adding leakage at frequencies including the diverged frequencies, attenuating some or all of the W-filter coefficients, or reducing the step size to lower the risk of future divergence events.

The divergence controller 562 may be a dedicated controller for detecting diverged controllable W-filters or may be integrated with another controller or processor in the ANC system, such as the LMS controller 520. Alternatively, the divergence controller 562 may be integrated into another controller or processor within vehicle 102 that is separate from the other components in the ANC system 500.

Although FIG. 5 specifically shows an ANC system with processing in both the time and frequency domains, ANC systems realized solely with time domain processing are possible. In this case, the secondary path estimate is stored in the time domain, and the LMS update also occurs in the time domain. In an embodiment, divergence detection by the divergence controller 562 can also occur in the time domain. In another embodiment, an FFT of the time domain W-filter can allow divergence detection by computing parameters from the frequency domain W-filter.

Figure 6:
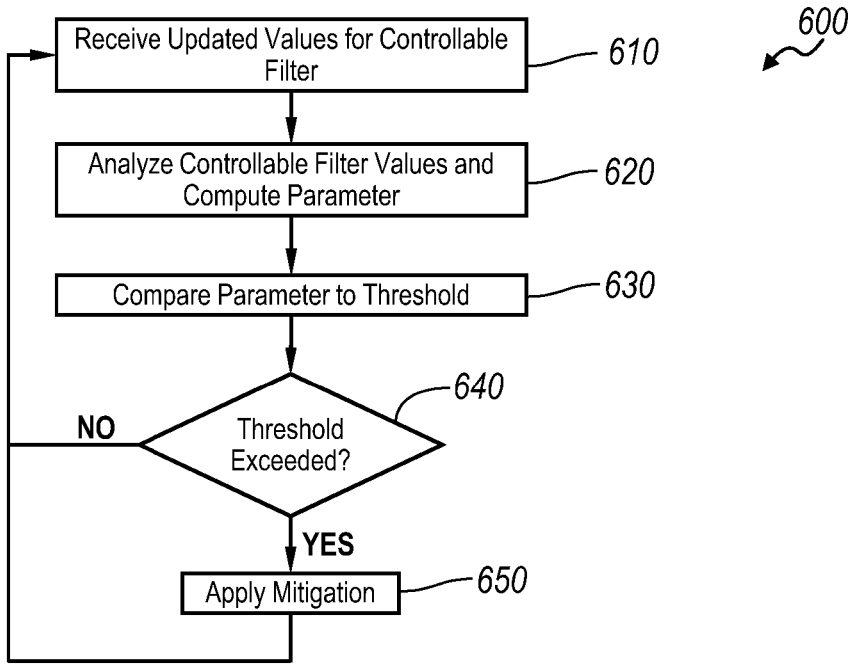
FIG. 6 is a flowchart depicting a method for detecting an correcting divergence of adaptive filters in an ANC system, in accordance with one or more embodiments of the present disclosure.

FIG. 6 is a flowchart depicting a method 600 for mitigating the effects of diverged or mis-adapted controllable W-filters in the ANC system 500. Various steps of the disclosed method may be carried out by the divergence controller 562, either alone, or in conjunction with other components of the ANC system.

At step 610, the divergence controller 562 may receive input indicative of one or more controllable filters 518 in the time domain (i.e., $w_{r,l}[n]$) and/or frequency domain (i.e., $W_{r,l}[k]$). To this end, a group of samples of time domain or frequency domain filter coefficients output from the adaptive filter controller 520 may be received by the divergence controller 562. In an embodiment, the controllable W-filter may consist of 128 taps in the time domain. In alternate embodiments, greater or fewer filter taps are possible. The filter values or coefficients may be received from the LMS adaptive filter controller 520 and may represent a current adaptation of the controllable filter 518. As set forth above, each controllable filter 518 is continuously adapted by the adaptive filter controller 520 and its rate of change is limited by the step size. The update rate of the controllable filter 518 may be set by the sample rate and block length of the incoming $X_r[k,n]$) and $E_m[k,n]$) data. The divergence controller 562 may receive these updated W-filter coefficients for each controllable filter.

At step 620, an analysis of the W-filter data may be performed, and one or more parameters may be computed in either the time or frequency domain. Several methods exist to detect divergence or mis-adaptation in the time domain version of a controllable W-filter based on an analysis of the filter coefficients. In one embodiment, the parameter computed by the divergence controller 562 may be the sum of the absolute values of the taps in the entire controllable W-filter. In another embodiment, the parameter computed by the divergence controller 562 may be the sum of the absolute values of the taps in a latter portion of the controllable W-filter, such as the second half or the last quarter of the controllable filter's coefficients. In yet another embodiment, the parameter may be the maximum value of the individual tap values in at least a portion of the controllable filter, such as the second half (or last quarter), to determine if any exceed a pre-determined amplitude. Controllable filter property parameters may also be computed in the frequency domain. The parameters computed in the frequency domain may include, for instance, the phase deviation over a frequency range. In another embodiment, the parameter computed by the divergence controller 562 may be the sum of all of or a portion of the W-filter coefficients. In yet another embodiment, the parameter may be the maximum value of the W-filter coefficients in at least a portion of the controllable W-filter's frequency range. In various embodiments, these sums or maximum values may be computed using the real, imaginary, or magnitude of the W-filter coefficients.

Step 620 may also include storing the parameter(s) and/or current W-filter values for use in performing future W-filter analyses. In an embodiment, the parameter(s) or W-filter data from the W-filter immediately prior to a current W-filter may be stored. In another embodiment, a statistical analysis may be performed on the parameters obtained from multiple prior W-filters (e.g., to determine a threshold). For instance, a short- or long-term average of a parameter obtained from multiple preceding W-filters may be calculated and stored as its own parameter for use in step 630, either as a threshold or to obtain a difference from the current W-filter for comparison to a threshold. In certain of these embodiments, a predetermined gain margin may be added to the average value (or other statistical value) calculated from multiple preceding W-filters to form a threshold. This may include adding a gain margin of 20%, 50% or 100% to the average value or other statistical value. Thus, the average value from multiple preceding W-filters may be multiplied by a gain factor (e.g., 120%, 150%, 200%, etc.) to obtain the threshold. In other embodiments, other gain factors are possible. Additionally, one or more controllable W-filters may be stored for future use in mitigating W-filter divergence.

At step 630, the parameter computed from the current controllable W-filter may be compared directly to a corresponding threshold. If the parameter from the current W-filter exceeds the threshold, the divergence controller 562 may conclude that divergence or mis-adaptation has been detected. If the parameter from the current W-filter does not exceed the threshold, the divergence controller 562 may conclude that no divergence or mis-adaptation has been detected. For instance, the divergence controller 562 may compute the highest magnitude frequency domain W-filter coefficient value or the average of the absolute values in the last one-tenth of the time domain filter taps of a W-filter and compare the peak amplitude or sum to a corresponding threshold to determine whether a divergence or mis-adaptation event has occurred. As another example, if the phase difference between the beginning and end of the frequency range exceeds a threshold, divergence may be detected.

Alternatively, the parameter computed from the current W-filter may be compared to a statistical value (e.g., average value) of the same parameter from one or more previous W-filters, as previously described. The difference between the current W-filter's parameter and the statistical value may then be compared to a threshold, which can be called a W Threshold. If the difference exceeds the threshold, the divergence controller 562 may conclude that divergence or mis-adaptation has been detected. If the difference does not exceed the threshold, the divergence controller 562 may conclude that no divergence has occurred. For example, in an embodiment, the divergence controller 562 may compute the average of the absolute values in the last one-sixth of the time domain filter taps of a W-filter and compare it to a previous W-filter's average of the absolute values in the last one-tenth of the time domain filter taps of a W-filter, noting that any difference exceeding a predetermined threshold may be indicative of divergence of the W-filter.

In one or more embodiments, the threshold may be a predetermined static threshold set and programmed by trained engineers during the tuning of the ANC system and its corresponding algorithms. In alternate embodiments, the threshold may be a dynamic threshold computed from a statistical analysis of the parameter obtained in one or more preceding W-filters as discussed above with regard to step 620. For instance, the threshold may be a short- or long-term average value of a parameter taken from multiple preceding W-filters. Moreover, the average value may be enhanced by a gain factor, as previously discussed, to establish the dynamic threshold. In yet another embodiment, the threshold may simply be the value of the parameter from the previous W-filter, which may also be multiplied by a gain factor.

Referring to step 640, when a threshold has been exceeded indicating divergence of the controllable filter, the method may proceed to step 650. At step 650, mitigating measures may be applied to the diverged controllable W-filter to minimize the in-cabin noise boosting or reduced ANC effects of W-filter divergence. However, when no W-filter divergence is detected, the method may skip any mitigation and return to step 610 so the process can repeat with new W-filter coefficients corresponding to the next filter adaptation.

At step 650, the divergence mitigation may be applied to any of either or both the time domain or frequency domain W-filters that have diverged or mis-adapted. In general, this may involve modifying properties of at least one controllable filter 518 in which divergence has been detected. Such properties may be modified based in part on, or in response to, an adjustment signal sent from the divergence controller 562 to the adaptive filter controller 520. In certain embodiments, the counter measures may be applied to an entire W-filter or only to specific frequencies for a frequency domain W-filter. The mitigation methods that can be applied to the entire controllable W-filter (in either the time or frequency domain) may include re-setting the filter coefficients of one or more W-filters to zero to allow it to re-adapt or setting the filter coefficients to a set of filter coefficient values stored in a memory of the ANC system. The set of filter coefficient values stored in memory may include those from a W-filter in a known good state, such as a W-filter that has been tuned by trained engineers or were obtained from the controllable filter prior to when divergence was detected. For instance, the controllable filter may be re-set using filter coefficients it had, for example, 10 seconds or 1 minute prior to divergence. Alternatively, the controllable W-filter may be reset to an initial condition, such as when the ANC system 500 was powered on. Another mitigation technique may be to simply deactivate or mute the ANC system when divergence has been detected. In an embodiment, only the W-filters that have diverged can be deactivated or set to zero and not allowed to adapt when divergence has been detected. In an embodiment, the amplitude of all the filter taps or magnitude of all the frequency domain filter coefficients can be reduced when divergence has been detected. Properties of the controllable W-filter can be modified directly, such as by setting filter coefficients to a specific value. Alternatively, properties of the controllable W-filter 518 can be modified indirectly. For instance, the value of leakage at all frequencies can be increased by the adaptive filter controller 520 in response to an adjustment signal from the divergence controller 562 when divergence has been detected.

Counter measures which apply only to the frequency-domain approach may include attenuating the W-filter coefficients at or near the diverged frequencies and adding or increasing the value of leakage at or near the diverged frequencies. In an embodiment for mitigation applied in the frequency domain, the divergence controller 562 can adaptively notch out unstable, diverged frequencies identified in step 630, by adding notch or band reject filters on input signals $x_r[n]$ and $e_m[n]$ or their frequency domain counterparts. This may prevent the adaptive filter controller 520 from increasing the magnitude of the W-filters in a problematic frequency range in future operation of the ANC system 500. This can optionally be accompanied by a resetting of the W-filters outlined above, or the use of leakage at these unstable, diverged frequencies or all frequencies.

As previously mentioned, in one or more additional embodiments, the value of leakage can be increased at the LMS adaptive filter controller 520 when divergence has been detected, such as when the highest magnitude W-filter coefficient exceeds a predetermined threshold. Increasing the leakage value of the adaptive filter controller 520 may decrease the magnitude of the controllable w-filter 518. This leakage value can be continuously increased by a predetermined amount with each iteration through the process flow shown in FIG. 6 so long as the highest magnitude W-filter coefficient still exceeds the predetermined threshold. Once the highest magnitude W-filter coefficient no longer exceeds the predetermined threshold, the value of leakage can be decreased by a predetermined amount during subsequent iterations through the process flow shown in FIG. 6 as long as the highest magnitude W-filter coefficient no longer exceeds the predetermined threshold. Decreasing the leakage value of the adaptive filter controller 520 may increase the magnitude of the controllable W-filter 518. In this manner, the leakage value of the adaptive filter controller may be continuously adjusted up and down based on the magnitude of filter coefficients in relation to a threshold.

In an embodiment, leakage is increased for all W-filters in the ANC system 500 when the highest magnitude W-filter coefficient of any of the W-filters exceeds the predetermined threshold. In another embodiment, the leakage is increased on all the W-filters for a particular speaker when the highest magnitude W-filter coefficient of any of the W-filters associated with that speaker exceeds the predetermined threshold. The LMS controller 520 may be instructed to increase or decrease the leakage value in response to receiving the adjustment signal from the divergence controller 562. As previously described, adjusting the leakage value for one or more of the controllable filters 518 may indirectly impact the magnitude of the W-filter coefficients. For instance, increasing the leakage may generally decrease the magnitude of the filter coefficients, while decreasing leakage may generally increase the magnitude of the filter coefficients.

As previously described, there exists one controllable W-filter for each combination of speaker 512 and noise input (e.g., each engine order or vibration sensor). Accordingly, a 12-accelerometer, 6-speaker RNC system will have 72 W-filters (i.e., 12×6=72) and a 5-engine order, 6-speaker EOC system will have 30 W-filters (i.e., 5×6=30). The method 600 illustrated in FIG. 6 can be performed after every new set of W-filters is calculated, or less frequently, in order to reduce the computational power required, thereby saving CPU cycles.

Figure 7:
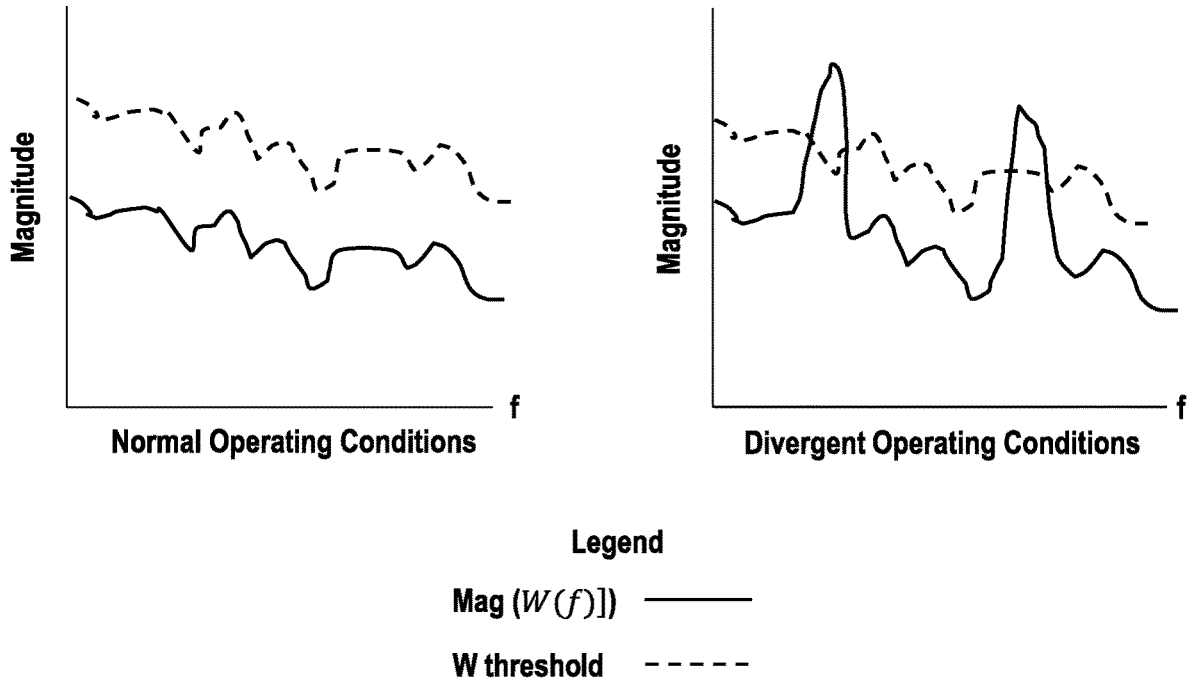
FIG. 7 is a graphical representation of the analysis of a controllable filter in the frequency domain using a threshold, in accordance with one or more embodiments of the present disclosure.

FIG. 7 depicts an exemplary analysis of the frequency domain threshold comparison. The ANC system 500 may store a set of threshold limits for each controllable filter (i.e., the W threshold). Under normal operating conditions, all controllable W-filter points are less than the W threshold. Under divergent or mis-adapted operating conditions, one or more coefficients of the W-filter exceed the W threshold. The divergence controller 562 may detect and indicate which W-filter, and/or which bins of the W-filter, have exceeded the W threshold such that the adaptive filter controller 520 or the divergence controller 562 may apply countermeasures.

Although FIGS. 1, 3, and 5 show LMS-based adaptive filter controllers 120, 320, and 520, respectively, other methods and devices to adapt or create optimal controllable W-filters 118, 318, and 518 are possible. For example, in one or more embodiments, neural networks may be employed to create and optimize W-filters in place of the LMS adaptive filter controllers. In other embodiments, machine learning or artificial intelligence may be used to create optimal W-filters in place of the LMS adaptive filter controllers.

In the foregoing specification, the inventive subject matter has been described with reference to specific exemplary embodiments. Various modifications and changes may be made, however, without departing from the scope of the inventive subject matter as set forth in the claims. The specification and figures are illustrative, rather than restrictive, and modifications are intended to be included within the scope of the inventive subject matter. Accordingly, the scope of the inventive subject matter should be determined by the claims and their legal equivalents rather than by merely the examples described.

For example, the steps recited in any method or process claims may be executed in any order and are not limited to the specific order presented in the claims. Equations may be implemented with a filter to minimize effects of signal noises. Additionally, the components and/or elements recited in any apparatus claims may be assembled or otherwise operationally configured in a variety of permutations and are accordingly not limited to the specific configuration recited in the claims.

Those of ordinary skill in the art understand that functionally equivalent processing steps can be undertaken in either the time or frequency domain. Accordingly, though not explicitly stated for each signal processing block in the figures, particularly FIGS. 1-3, the signal processing may occur in either the time domain, the frequency domain, or a combination thereof. Moreover, though various processing steps are explained in the typical terms of digital signal processing, equivalent steps may be performed using analog signal processing without departing from the scope of the present disclosure Benefits, advantages and solutions to problems have been described above with regard to particular embodiments. However, any benefit, advantage, solution to problems or any element that may cause any particular benefit, advantage or solution to occur or to become more pronounced are not to be construed as critical, required or essential features or components of any or all the claims.

The terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the inventive subject matter, in addition to those not specifically recited, may be varied or otherwise particularly adapted to specific environments, manufacturing specifications, design parameters or other operating requirements without departing from the general principles of the same.

What is claimed is:

1. A method for controlling stability in an active noise cancellation (ANC) system, the method comprising:

receiving, from an adaptive filter controller, filter coefficients corresponding to at least one controllable filter;

computing a parameter based on an analysis of at least a portion of the filter coefficients;

detecting divergence of the at least one controllable filter based on a comparison of the parameter to a threshold, wherein the threshold is a dynamic threshold computed from a statistical analysis of the parameter computed from filter coefficients in one or more preceding adaptations of the at least one controllable filter; and modifying properties of the at least one controllable filter that has diverged.

2. The method of claim 1, wherein the controllable filter includes a plurality of coefficients, the parameter being a sum of absolute values of at least a portion of the coefficients in the at least one controllable filter.

3. The method of claim 1, wherein the controllable filter includes a plurality of coefficients, the parameter being a maximum value of at least a portion of the coefficients in the at least one controllable filter.

4. The method of claim 1, wherein detecting divergence of the at least one controllable filter based on a comparison of the parameter to a threshold comprises detecting divergence of the at least one controllable filter when the parameter exceeds the threshold.

5. The method of claim 1, wherein the threshold is an average value of the parameter taken from multiple preceding adaptations of the at least one controllable filter multiplied by a gain factor.

6. The method of claim 1, wherein modifying properties of the at least one controllable filter that has diverged comprises deactivating at least one of the ANC system and the at least one controllable filter that has diverged.

7. The method of claim 1, wherein modifying properties of the at least one controllable filter that has diverged comprises resetting the filter coefficients of the at least one controllable filter to zero and allowing the at least one controllable filter to re-adapt.

8. The method of claim 1, wherein modifying properties of the at least one controllable filter that has diverged comprises resetting the filter coefficients of the at least one controllable filter to a set of filter coefficient values stored in a memory of the ANC system.

9. The method of claim 1, wherein modifying properties of the at least one controllable filter that has diverged comprises increasing a leakage value of the adaptive filter controller in response to detecting divergence of the at least one controllable filter.

10. The method of claim 9, wherein the leakage value of the adaptive filter controller is increased at the diverged frequencies of the at least one controllable filter.

11. The method of claim 9, further comprising:

decreasing the leakage value of the adaptive filter controller when a highest magnitude filter coefficient of the at least one controllable filter falls below a predetermined threshold.

12. An active noise cancellation (ANC) system comprising:

at least one controllable filter configured to generate an anti-noise signal based on an adaptive transfer characteristic and a noise signal received from a sensor, the adaptive transfer characteristic of the at least one controllable filter characterized by a set of filter coefficients;

an adaptive filter controller, including a processor and memory, programmed to adapt the set of filter coefficients based on the noise signal and an error signal received from a microphone located in a cabin of a vehicle; and a divergence controller in communication with at least the adaptive filter controller, the divergence controller including a processor and memory programmed to:

receive the set of filter coefficients corresponding to a current adaptation of the adaptive transfer characteristic of the at least one controllable filter;

compute a parameter based on an analysis of at least a portion of the set of filter coefficients; and detect divergence of the at least one controllable filter when a difference between the parameter computed from the current adaptation of the at least one controllable filter and an average value of the same parameter from one or more previous adaptations of the at least one controllable filter exceeds a threshold.

13. The ANC system of claim 12, wherein the threshold is a predetermined static threshold programmed for the ANC system.

14. The ANC system of claim 12, wherein the divergence controller is further programmed to increase a leakage value of the adaptive filter controller in response to detecting divergence of the at least one controllable filter.

15. A computer-program product embodied in a non-transitory computer readable medium that is programmed for active noise cancellation (ANC), the computer-program product comprising instructions for:

receiving, from an adaptive filter controller, a set of filter coefficients corresponding to a current adaptation of at least one controllable filter;

computing a parameter based on an analysis of at least a portion of the filter coefficients;

detecting divergence of the at least one controllable filter when a difference between the parameter computed from the current adaptation of the at least one controllable filter and an average value of the same parameter from one or more previous adaptations exceeds a threshold; and modifying an adaptive transfer characteristic of the at least one controllable filter during the current adaptation in response to detecting divergence of the at least one controllable filter.

16. The computer-program product of claim 15, wherein the instructions for detecting divergence of the at least one controllable filter includes detecting, in the time domain, diverged frequencies of the at least one controllable filter; and wherein the instructions for modifying the adaptive transfer characteristic includes, in the time domain, resetting the diverged frequencies of the at least one controllable filter to zero, attenuating the filter coefficients at the diverged frequencies, or increasing a leakage value of the adaptive filter controller at the diverged frequencies.

17. The computer-program product of claim 15, wherein the instructions for detecting divergence of the at least one controllable filter includes detecting, in the frequency domain, diverged frequencies of the at least one controllable filter; and wherein the instructions for modifying the adaptive transfer characteristic includes, in the frequency domain, notching out the diverged frequencies using an error signal received from a microphone and filter coefficients from a previous adaptation of the at least one controllable filter stored in memory.

* * * * *